US008813854B2

(12) United States Patent
Sahni et al.

(10) Patent No.: US 8,813,854 B2
(45) Date of Patent: Aug. 26, 2014

(54) SYSTEM AND METHOD FOR WATERFLOODING OFFSHORE RESERVOIRS

(75) Inventors: Akshay Sahni, Bakersfield, CA (US); Jarrad Rexilius, North Fremantle (AU)

(73) Assignee: Chevron U.S.A. Inc., San Ramon, CA (US)

( * ) Notice: Subject to any disclaimer, the term of this patent is extended or adjusted under 35 U.S.C. 154(b) by 653 days.

(21) Appl. No.: 12/974,656

(22) Filed: Dec. 21, 2010

(65) Prior Publication Data

US 2011/0146993 A1 Jun. 23, 2011

Related U.S. Application Data

(60) Provisional application No. 61/288,430, filed on Dec. 21, 2009.

(51) Int. Cl.
*E21B 43/01* (2006.01)
*E21B 43/16* (2006.01)

(52) U.S. Cl.
USPC ..... 166/366; 166/352; 166/268; 166/263; 166/369; 405/224.2

(58) Field of Classification Search
USPC ..... 166/366, 352, 268, 263, 305.1, 311, 166/312, 369, 372, 90.1; 405/224.2, 224.3
See application file for complete search history.

(56) References Cited

U.S. PATENT DOCUMENTS

| | | | | |
|---|---|---|---|---|
| 2,953,204 | A * | 9/1960 | Doscher et al. | 166/266 |
| 4,077,428 | A * | 3/1978 | Weaver | 137/565.3 |
| 4,195,653 | A * | 4/1980 | Cessou | 137/206 |
| 4,287,903 | A * | 9/1981 | Cessou | 137/13 |
| 4,635,723 | A * | 1/1987 | Spivey | 166/310 |
| 4,836,935 | A * | 6/1989 | Lilienthal | 210/788 |
| 4,848,471 | A * | 7/1989 | Bencze | 166/335 |
| 5,415,232 | A * | 5/1995 | Johnson et al. | 166/307 |
| 6,536,528 | B1 * | 3/2003 | Amin et al. | 166/369 |
| 7,152,682 | B2 * | 12/2006 | Hopper | 166/357 |
| 7,686,086 | B2 * | 3/2010 | Brammer | 166/357 |
| 7,841,394 | B2 * | 11/2010 | McNeel et al. | 166/90.1 |
| 7,931,082 | B2 * | 4/2011 | Surjaatmadja | 166/268 |
| 7,963,335 | B2 * | 6/2011 | Krehbiel et al. | 166/335 |
| 2004/0168811 | A1 * | 9/2004 | Shaw et al. | 166/368 |
| 2004/0244980 | A1 * | 12/2004 | Appleford et al. | 166/305.1 |
| 2009/0050320 | A1 * | 2/2009 | Collins et al. | 166/266 |
| 2010/0180810 | A1 * | 7/2010 | Liberg | 114/125 |
| 2010/0276146 | A1 * | 11/2010 | Smith | 166/302 |

FOREIGN PATENT DOCUMENTS

| | | |
|---|---|---|
| EP | 0201263 | 12/1986 |

OTHER PUBLICATIONS

International Search Report and Written Opinion of the International Searching Authority, PCT/US2010/061432, Jun. 23, 2011.

* cited by examiner

*Primary Examiner* — Matthew Buck
(74) *Attorney, Agent, or Firm* — A. Stephen Zavell

(57) ABSTRACT

A mobile water injection system and method for performing waterflooding in offshore reservoirs, and more particularly to enhance oil recovery in marginal offshore reservoirs is disclosed. The mobile water injection system and method include portable equipment, including a submersible pump to recover water from a body of water, a water storage tank, filtration and chemical treatment equipment to treat the recovered water, and an injection pump to pump the treated water at high pressure into the reservoir such that the residual oil is driven to adjacent production wells to increase oil recovery.

11 Claims, 9 Drawing Sheets

SYSTEM AND METHOD FOR WATERFLOODING OFFSHORE RESERVOIRS

CROSS-REFERENCE TO RELATED APPLICATIONS

The present application for patent claims the benefit of U.S. Provisional Application bearing Ser. No. 61/288,430, filed on Dec. 21, 2009, which is incorporated by reference in its entirety.

TECHNICAL FIELD

The present invention generally relates to a system and method for waterflooding offshore reservoirs to enhance oil recovery, and more particularly, to a portable system and method for waterflooding marginal offshore reservoirs to enhance oil recovery.

BACKGROUND

Reservoir systems, such as petroleum reservoirs, typically contain fluids such as water and a mixture of hydrocarbons such as oil and gas. To produce the hydrocarbons from the reservoir, different mechanisms can be utilized such as primary, secondary or tertiary recovery processes.

In a primary recovery process, hydrocarbons are displaced from a reservoir due to the high natural differential pressure between the reservoir and the bottomhole pressure within a wellbore. The reservoir's energy and natural forces drive the hydrocarbons contained in the reservoir into the production well and up to the surface. Artificial lift systems, such as sucker rod pumps, electrical submersible pumps or gas-lift systems, are often implemented in the primary production stage to reduce the bottomhole pressure within the well. Such systems increase the differential pressure between the reservoir and the wellbore intake; thus, increasing hydrocarbon production. However, even with use of such artificial lift systems only a small fraction of the original-oil-in-place (OOIP) is typically recovered using primary recovery processes as the reservoir pressure, and the differential pressure between the reservoir and the wellbore intake, declines overtime due to production. For example, typically only about 10-20% of the OOIP can be produced before primary recovery reaches its limit—either when the reservoir pressure is too low that the production rates are not economical, or when the proportions of gas or water in the production stream are too high.

In order to increase the production life of the reservoir, secondary or tertiary recovery processes can be used. Typically in these processes, fluids such as water, gas, surfactant, or combination thereof, are injected into the reservoir to maintain reservoir pressure and drive the hydrocarbons to producing wells. For example, typically an additional 10-50% of OOIP can be produced in addition to that produced during primary recovery. The most commonly used secondary recovery process is waterflooding, which is often referred to as an improved oil recovery (IOR) process, and involves the injection of water into the reservoir to displace or physically sweep the residual oil to adjacent production wells.

Waterflooding operations typically require a sufficient supply of water for injection, water purification systems to filter and chemically treat the source water, a pumping or injection system, and access to the reservoir formation via a wellbore. While waterflooding processes may be more economical than other oil recovery processes, waterflooding operations present logistical and economic limitations that can preclude the use of waterflooding, especially when operating in offshore environments.

In offshore or marine waterflood operations, the production and injection wells are subsea, or below a body of water, and access to the wells is primarily via a platform or production vessel. Produced water can be processed and used as a supply source of injection water; alternatively, seawater can be recovered, treated, and injected into the injection wells. Such fluid processing/treatment facilities are often located on centralized injection platforms connected to various injection wells via submarine pipelines, as the injection wells are typically positioned remotely along the perimeter of the reservoir.

The capital and operational costs, as well as, logistical constraints of a waterflood therefore, often dictate whether waterflooding is a feasible candidate for recovery in a reservoir. Historically waterflooding in marginal oil reservoirs, where the OOIP typically ranges between 0.25-2 million stock tank barrels (MMSTB), has not been feasible, even when incremental waterflood reserves could be up to double those of primary reserves. For example, the predicted incremental oil obtained from waterflooding marginal offshore reservoirs typically would not offset the cost of injection pumps and laying pipelines supplying injection water to the remote platforms. Waterflood recovery is also dependent on the timing of water injection and delays in getting water in the ground may result in loss of recovery. Furthermore, seawater injection systems installed on remote platforms are structurally not viable as they are challenged by weight constraints, space constraints, and limited mobility.

SUMMARY

According to an aspect of the present invention, a method of performing waterflooding in a subsea reservoir is disclosed. The method includes providing a subsea reservoir having hydrocarbons therewithin and a plurality of offshore platforms each having a wellbore in fluid communication with the subsea reservoir. A portable waterflooding injection system is assembled on one of the plurality of offshore platforms. The portable waterflooding injection system includes a submersible pump to recover sea water, a tank to hold the seawater, and an injection pump to pump the sea water into the subsea reservoir. Sea water is injected into the subsea reservoir for a predetermined amount of time using the portable waterflooding injection system. Hydrocarbons are produced from the subsea reservoir.

In one embodiment, the portable waterflooding injection system is disassembled from the offshore platform after the predetermined amount of time and transferred to another offshore platform for waterflooding.

In one embodiment, the sea water injected is injected through the wellbore on the offshore platform to which the portable waterflooding injection system is assembled.

In one embodiment, assembling the portable waterflooding injection system includes connecting the submersible pump below the sea surface to pump sea water to a deck of the offshore platform. The tank is mounted on the deck of the offshore platform such that it is in fluid communication with the submersible pump and receives sea water therefrom. The injection pump is mounted on the deck of the offshore platform. The injection pump is in fluid communication with the tank and the wellbore such that the injection pump receives the sea water from the tank and pumps it to the wellbore to waterflood the subsea reservoir.

In one embodiment, the submersible pump is mounted on a skid such that it can be lifted with a standard platform crane.

In one embodiment, the tank is mounted on a skid such that it can be lifted onto the deck with a standard platform crane.

In one embodiment, the injection pump is mounted on a skid such that it can be lifted onto the deck with a standard platform crane.

In one embodiment, seawater is injected into the wellbore at an injection rate of at least 4500 barrels of water per day.

In one embodiment, a tubing head pressure of at least 1000 p.s.i. is maintained in the wellbore while seawater is injected.

In one embodiment, each of the wellbores on the plurality of offshore platforms are components of production wells, and the production well on the offshore platform to which the portable waterflooding injection system is assembled is converted to an injection well prior to injection of sea water.

In one embodiment, the incremental hydrocarbon recovery obtained from utilizing the portable waterflooding injection system is forecasted for each of the plurality of offshore platforms. The portable waterflooding injection system is then utilized on each of the plurality of offshore platforms in an order based on the forecasted incremental hydrocarbon recovery.

According to another aspect of the present invention, a method of performing waterflooding in a subsea reservoir is disclosed. The method includes providing a subsea reservoir having hydrocarbons therewithin and an offshore platform having a production well in fluid communication with the subsea reservoir. The production well is converted to an injection well. A portable waterflooding injection system is transported to the offshore platform. The portable waterflooding injection system includes a submersible pump to recover sea water, a tank to hold the seawater, and an injection pump to pump the sea water to the injection well. Sea water is injected through the injection well into the subsea reservoir for a predetermined amount of time using the portable waterflooding injection system.

In one embodiment, hydrocarbons are produced from the subsea reservoir using a second production well that is in fluid communication with the subsea reservoir and the offshore platform.

In one embodiment, the submersible pump is connected below the sea surface to pump sea water to a deck of the offshore platform. The tank is mounted on the deck of the offshore platform such that it is in fluid communication with the submersible pump and receives sea water therefrom. The injection pump is mounted on the deck of the offshore platform. The injection pump is in fluid communication with the tank and the injection well such that the injection pump receives the sea water from the tank and pumps it through the injection well into the subsea reservoir.

In one embodiment, seawater is injected into the injection well at an injection rate of at least 4500 barrels of water per day and a tubing head pressure of at least 1000 p.s.i. is maintained in the injection well.

In one embodiment, the submersible pump, the tank, and the injection pump are each mounted on a skid such that they can be lifted with a standard platform crane.

According to another aspect of the present invention, a method of optimizing a waterflood in a subsea reservoir is disclosed. The method includes providing a subsea reservoir having hydrocarbons therewithin and a plurality of offshore platforms each having a wellbore in fluid communication with the subsea reservoir. A portable waterflooding injection system is also provided. The portable waterflooding injection system includes a submersible pump to recover sea water, a tank to hold the seawater, and an injection pump to pump the sea water into the subsea reservoir. The incremental hydrocarbon recovery obtained from utilizing the portable waterflooding injection system is forecasted for each of the plurality of offshore platforms. The portable waterflooding injection system is then utilized on each of the plurality of offshore platforms in an order based on the forecasted incremental hydrocarbon recovery.

In one embodiment, the portable waterflooding injection system is assembled on one of the plurality of offshore platforms and sea water is injected into the subsea reservoir for a predetermined amount of time using the portable waterflooding injection system. Hydrocarbons are produced from the subsea reservoir.

In one embodiment, each of the wellbores on the plurality of offshore platforms are components of production wells, and at least one production well on the offshore platform to which the portable waterflooding injection system is assembled is converted to an injection well prior to injection of sea water.

DETAILED DESCRIPTION

The system and method described herein is a mobile seawater injection system for performing waterflooding in offshore reservoirs, and more particularly to enhance oil recovery in marginal offshore reservoirs. As will be better understood in the further description below, the present system and method involves the use of portable equipment to recover seawater from the ocean and pump it at high pressure into an injection well such that the water drives the residual oil to adjacent production wells to increase oil recovery.

Figure 1:
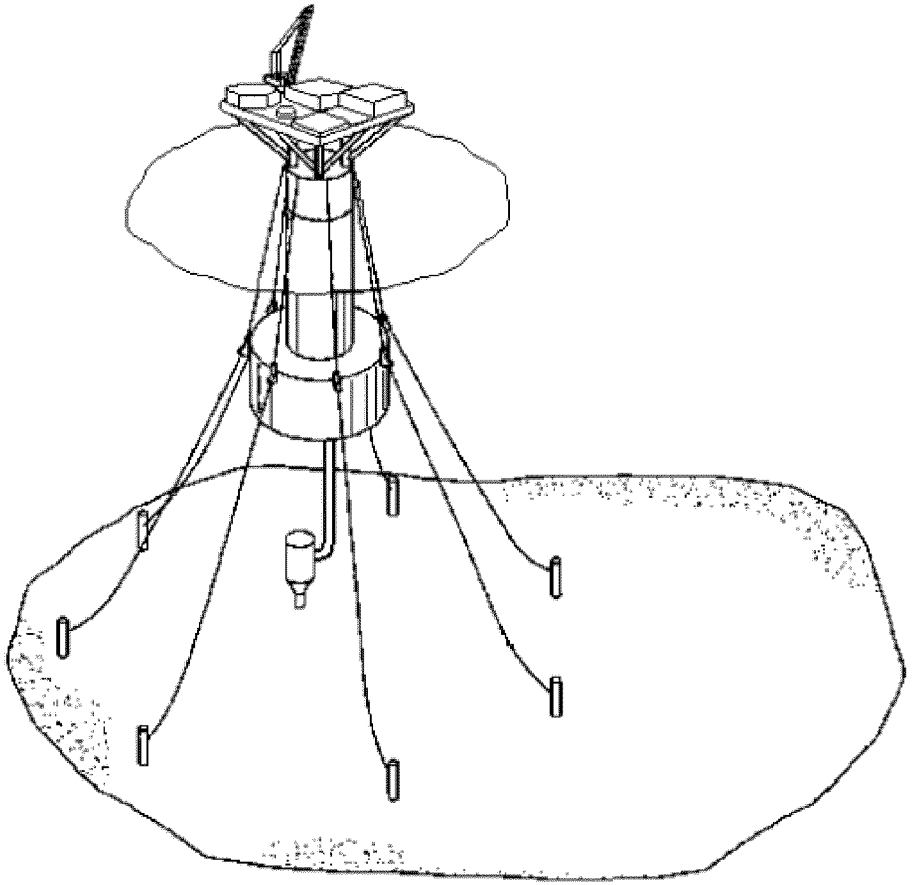
FIG. 1 is a schematic, environmental view of an offshore platform according to an embodiment of the present invention for enhancing oil recovery from a subsea reservoir.

FIG. 1 is a schematic of a floating offshore platform in a marginal offshore reservoir, where the OOIP typically ranges between 0.25-2 million stock tank barrels (MMSTB). The offshore platform is in an area without conventional water injection facilities in place. Further, such conventional water injection facilities are not economically feasible as the capital costs of the injection pumps and laying pipelines supplying injection water to the offshore platform would not be offset by the predicted incremental oil obtained from waterflooding the reservoir. Additionally, the platform is not structurally viable due to weight constraints, space constraints, and limited mobility. As will be described, a mobile seawater injection system is therefore utilized for waterflooding the marginal offshore reservoir.

Figure 2:
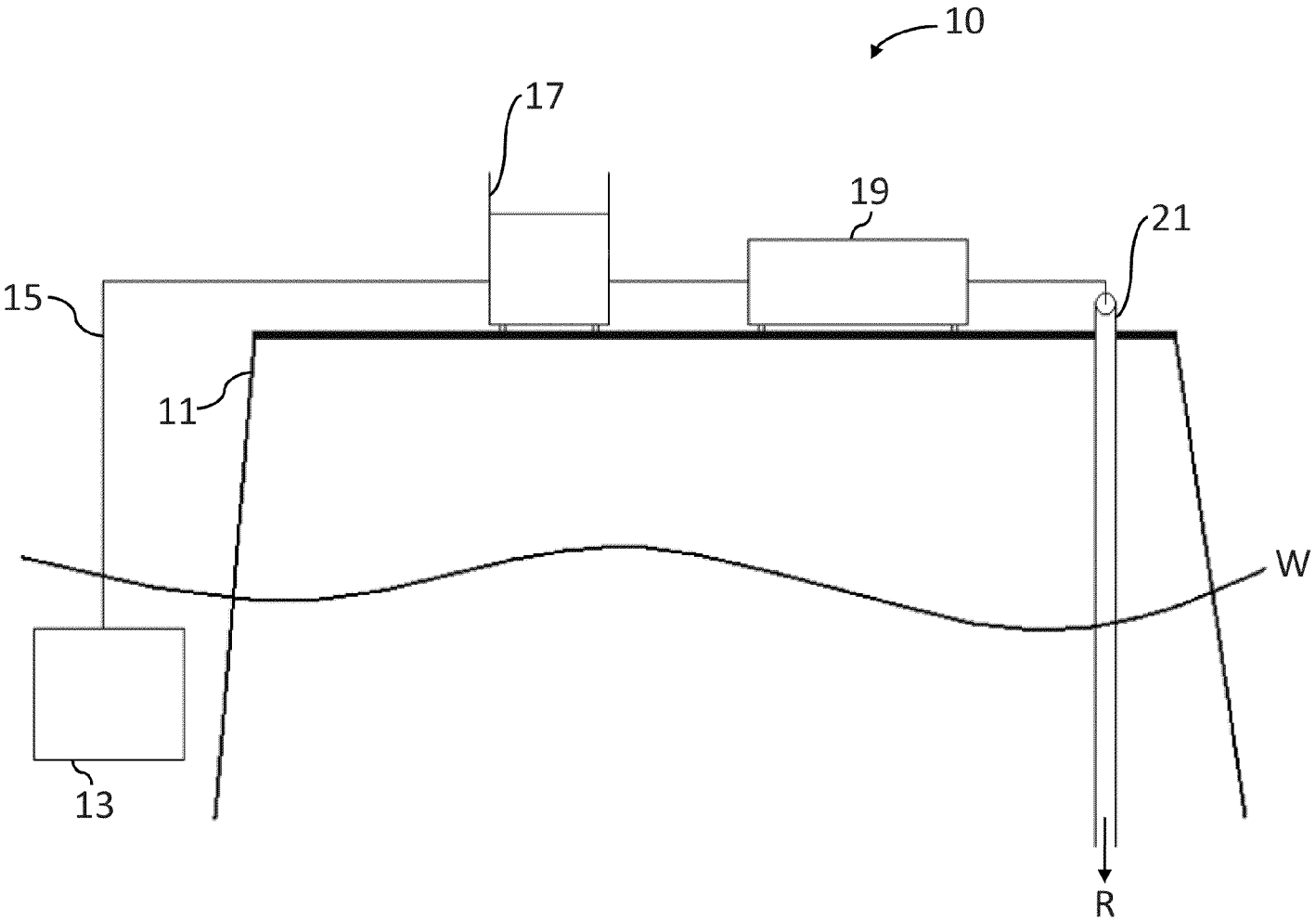
FIG. 2 is a schematic, sectional view of a waterflooding injection system according to an embodiment of the present invention for enhancing oil recovery from a subsea reservoir.

FIG. 2 is a schematic of mobile seawater injection system 10 for use in waterflooding offshore reservoirs, such as the marginal offshore reservoir shown in FIG. 1. Seawater injection system 10 is positioned on an offshore platform 11 having the top of offshore platform 11 elevated above sea level W. Offshore platform 11 can be a floating platform or a fixed platform. As used herein, the offshore environment and other related terms are described in terms of the sea or ocean, and it should be understood that the injection system and method described herein may be utilized in fresh water as well. Submersible pump 13, or the intake to submersible pump 13, is situated below sea level W such that submersible pump 13 can recover seawater from the ocean and pump it though transfer hose 15 into holding tank 17. Holding tank 17 is in fluid communication with pumping system 19 such that holding tank 17 delivers a steady supply of water to pumping system 19. Both holding tank 17 and pumping system 19 are mounted to offshore platform 11. Water from holding tank 17 is pressured by pumping system 19 and delivered to injection well 21 such that the pressurized water is injected into subsea reservoir R for displacing oil and driving it to adjacent production wells to enhance oil recovery from subsea reservoir R.

In one or more embodiments, submersible pump 13 is an electrical submersible pump (ESP). Electrical submersible pumps are commonly used in the petroleum industry for positioning at the bottom of a production wellbore for producing a fluid. Submersible pump 13 is attached to offshore platform 11 (attachment not shown) and pumps seawater through transfer hose 15 to the deck of offshore platform 11. For example, submersible pump 13 can pump sea water through transfer hose 15 into holding tank 17 at a rate of 5 barrels per minute (bpm), which is equivalent to 7200 barrels of water per day (bwpd). Submersible pump 13 can be fully or partially submerged below sea level W as long as the intake to submersible pump 13 is able to sufficiently push water to the surface of the offshore platform 11. One skilled in the art will appreciate that one or more submersible pumps 13 can be utilized in mobile seawater injection system 10 for recovery of seawater, and additional pumps can be provided in case of a failure or malfunction of the primary submersible pump 13. Transfer hose 15 can be any type of tubing structure, flexible or rigid, designed to carry fluids from submersible pump 13 to the surface of the offshore platform 11, such as to holding tank 17.

The seawater is stored in holding tank 17 before passing into high pressure pumping system 19. For example, holding tank 17 can be any storage tank sufficiently sized to provide a steady supply of water to pumping system 19. In one embodiment, holding tank 17 can store at least about 50 barrels of fluid. In another embodiment, holding tank 17 can store at least about 100 barrels of fluid. In another embodiment, holding tank 17 can store at least about 150 barrels of fluid. One skilled in the art will appreciate that one or more holding tanks 17 can be utilized in mobile seawater injection system 10 for storing recovered seawater.

Pumping system 19 is used to inject seawater into wellbore 21 for delivery into subsea reservoir R. Pumping system 19 can include one or more high pressure pumps mounted on the surface of offshore platform 11. For example, pumping system 19 can include two HT-400™ pumps, which are distributed by Halliburton, headquartered in Houston, Tex. The two HT-400™ pumps are used to pump seawater at a normal operating pressures of about 1000-2000 p.s.i., and up to pressures as high as about 4500 p.s.i., with maximum rates of about 3-4 barrels per minute or about 4500-5500 barrels of water per day. The pumps can be interchanged regularly, such as every 12 hours, to avoid overheating and to maintain the efficiency of the pumps. When operating with multiple pumps, the fluid stream can be controlled by a suction manifold (not shown) so that transferring flow from one pump to the other is fast with no downtime. The discharge from the pumping system 19 is delivered to the wellhead of wellbore 21 for injection into subsea reservoir R. For example, delivery of water to wellbore 21 can be through a high pressure flexible hose or Chiksan piping.

Figure 3:
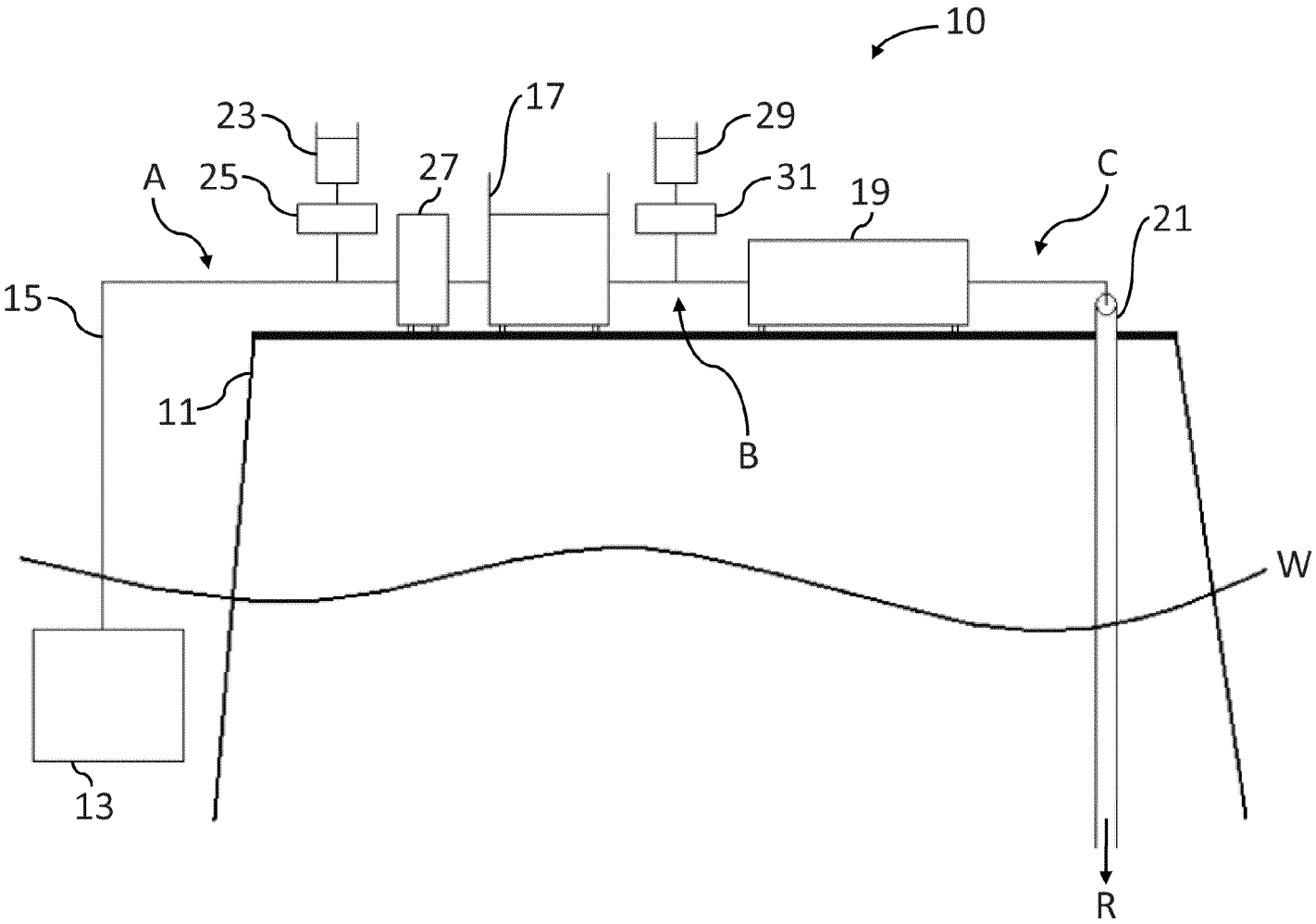
FIG. 3 is a schematic, sectional view of a waterflooding injection system according to an embodiment of the present invention for enhancing oil recovery from a subsea reservoir.

FIG. 3 shows an embodiment of mobile seawater injection system 10 such that the seawater recovered by submersible pump 13 undergoes filtration and chemical treatments. Treatment chemicals can be stored in chemical storage tank 23 and injected into transfer hose 15 upstream of holding tank 17, which is represented in FIG. 3 as region A, using injection pump 25. For example, one or more types of biocide can be continuously injected into the fluid stream upstream of holding tank 17. Alternatively, treatment chemicals can be injected as a batch treatment. One skilled in the art will appreciate that treatment chemicals can alternatively be injected into the seawater at region B located downstream of holding tank 17 and upstream of pumping system 19, or delivered in region C located downstream of pumping system 19. Furthermore, treatment chemicals can be injected directly into holding tank 17 or injection well 21.

Examples of treatment chemicals that can be stored in chemical storage tank 23 and injected into transfer hose 15 using injection pump 25 include EC6111E and EC6388A, both biocides produced and distributed by Nalco Company, headquartered Naperville, Ill. EC6111E is a biocide typically used for controlling microorganisms in oilfield water treatment systems and is a water soluble, non-ionic, and non-surface active biocide. In one or more embodiments, EC6111E can be continuously injected at a dosing of 10 gallons per day, which yields a treatment concentration of about 30 parts-per-million (ppm), assuming a seawater injection rate of 5000 barrels per day (bbl/day). In some embodiments, the treatment concentration of EC6111E is greater than about 30 parts-per-million (ppm). EC6388A is another biocide that can be used for water treatment, as some bacteria strains may be resistant to certain biocides, such as EC6111E. In one or more embodiments, EC6388A is batch treated for 4 hours, twice a week by injecting a 35-150 ppm biocide concentration, or as needed to maintain control into the fluid stream. In one or more embodiments, both EC6111E and EC6388A can be utilized, as injection of multiple types of biocides provides for optimum control and increased likelihood that all bacteria strains are affected.

In one or more embodiments, the seawater recovered by submersible pump 13 undergoes filtration prior to being delivered to holding tank 17. Filter 27 is positioned on offshore platform 11 to exclude marine organisms and other solid particles from the seawater stream. For example, filter 27 can be a 10, 15, 25, 50, or 100 micron filter. In one or more embodiments, one or more filters 27 can be used. Additionally, filter 27 can be located at region B located downstream of holding tank 17 and upstream of pumping system 19, at region C located downstream of pumping system 19, or a combination thereof.

In one or more embodiments, the seawater stored in holding tank 17 undergoes chemical treatment prior to delivery to pumping system 19. Treatment chemicals can be stored in chemical storage tank 29 and injected upstream of pumping system 19, which is represented in FIG. 3 as region B, using injection pump 31. Chemical storage tank 29 can be sized similarly to chemical storage tank 23 or they can be of different storage capacity. Similarly, injection pump 31 can operate the same as injection pump 27 or it can inject chemicals into the fluid stream at a different rate compared to injection pump 27. For example, one or more types of oxygen scavengers or scaling inhibitors can be injected, continuously or as a batch treatment, into the fluid stream upstream of pumping system 19. One skilled in the art will appreciate that such treatment chemicals can alternatively be injected into the seawater at region A located upstream of holding tank 17, delivered in region C located downstream of pumping system 19, or a combination thereof. Furthermore, such treatment chemicals can be injected directly into holding tank 17 or injection well 21.

An example of a treatment chemical that can be stored in chemical storage tank 29 and injected into the fluid stream using injection pump 31 is EC6067A, which is an oxygen scavenger produced and distributed by Nalco Company. In particular, EC6067A is a water solution of an inorganic sulphite-type compound which rapidly and efficiently removes dissolved oxygen from water injection systems, drilling fluids, and other fluids. In one or more embodiments, EC6067A is continuously injected into the fluid stream downstream of the water holding tank and upstream of the high pressure injection pump. For example, EC6067A can be stored in chemical storage tank 29, a tote tank having a storage capacity of at least about 250 gallons, and fed to a chemical injection pump 31, which injects the oxygen scavenger at a dosing of 40 gallons per 10,000 barrels of seawater, which is approximately a 90 ppm target concentration, to sufficiently remove all dissolved oxygen and provide a residual level of bisulphate to prevent reservoir souring. This is approximately 20 gallons per day treatment assuming a seawater injection rate of 5000 bbl/day.

In one or more embodiments, a corrosion inhibitor can also be stored in chemical storage tank 29 and injected into the fluid stream using injection pump 31. However, typically injection of a corrosion inhibitor is not necessary due to the duration of water injection being relatively short-term, as will be described later herein. Thus, water analysis can be performed regularly on the seawater and if it is shown that corrosion is a concern, then an inhibitor can be utilized.

In operation, mobile seawater injection system 10 is adapted for temporary deployment to unlock significant waterflood reserves distributed over small reservoirs across several platforms. Mobile seawater injection system 10 is modular, flexible and mobile such that it can quickly and cheaply inject water in the ground, resulting in incremental waterflood reserves, especially from marginal offshore oil reservoirs. For example, and without limitation, mobile seawater injection system 10 can be deployed in high permeability, homogeneous reservoirs (absence of high permeability thief zones) having a favorable mobility ratio environment, such that water displacement is stable even with high rates of injection. As with any waterflooding process, reservoir connectivity between the injector well and any adjacent production wells should be established prior to start of water injection. Continuity of the reservoir formation between injection wells and production wells can be confirmed using stratigraphic correlations, bottom-hole pressures, performing down-hole formation tests such as application of a Repeat Formation Tester (RFT), performing interference/pulse tests between the injector and producer, or a combination thereof. Processing reservoirs quickly with water injection accentuates the benefits of seawater injection system 10 and reduces the recovery costs ($/bbl) substantially.

Using mobile seawater injection system 10, quick bursts of water can be injected at rates significantly higher than off-take rates to quickly pressurize the reservoir and displace oil towards the producers, as long as, the pressures stay within the fracture pressure of the confining reservoir rock. Seawater injection system 10 is capable of hydraulically fracturing the waterflood reservoirs and sustaining fractures through injection of relatively cold sea-water (thermally induced fracture propagation). For reservoirs with mobility ratios in 0.5-1.5 ranges, displacement is stable even at high rates of injection, such as up to 3 times typical off-take rates. For example, the volumetric sweep efficiency does not drop at high rates of injection for homogeneous reservoirs with high permeability of about 300-500 millidarcies (mD), high dip (given down dip water injection), and light oils as they have a larger density difference between the oil and water phase. This allows for quick pressurization of these reservoirs such that mobile seawater injection system 10 can be demobilized and rigged up on another platform to repeat water injection. For example, mobile seawater injection system 10 injects water into a reservoir for a shortened time period compared to a typical waterflood, such as up until water breakthrough occurs in an adjacent production well. In some instances, the injectivity period of seawater injection system 10 is less than the water breakthrough point.

In one or more embodiments, each piece of equipment is mounted on a skid that is less than eleven metric tons and therefore, can be lifted and placed with standard platform cranes. This allows for a mobilization time of seawater injection system 10 to be approximately twelve hours for being removed from one offshore platform 11 and an addition twelve hours to be assembled for use on another offshore platform 11. Therefore, after mobile seawater injection system 10 has been used to inject seawater on a given platform or well for a specified period of time, mobile seawater injection system 10 can be rigged down, mobilized to another platform, rigged up, and begin operation all in about twenty-four hours.

In traditional or conventional water injection scenario's, laying a water pipeline and installing injection facilities on a platform can take several months or years before availability of steel and the fabrication of necessary parts. In comparison, seawater injection system 10 can be ready in a fraction of the time and installation requires no "hot" work, which includes welding, cutting, burning, abrasive blasting, and other heat-producing operations where there is an increased risk of fire. The timing of water injection and flexibility to start-up water injection early in the life of the producing reservoir can therefore be optimized using seawater injection system 10, which is critical to maximizing oil recovery.

Furthermore, seawater injection system 10 requires a small footprint on offshore platform 11. Sufficient space on a platform deck having seawater injection system 10 is available to spot standard slick-line and electric-line units for well intervention or workovers. This is important for most offshore oil and gas platforms where well workovers are required on a regular basis. Moreover, while chemical treatments, using chemical storage tanks 23, 29 and injection pumps 27, 31, respectively, treat seawater with biocides and ensure adequate defense against corrosion, they maintain a small footprint by avoiding complex treatments that require additional manpower, equipment and cost.

In one or more embodiments, existing production wells are converted to injection wells to save on costs of drilling new injection wells. This helps enable economic recovery from small offshore oil reservoirs that would usually not be subjected to waterflooding.

EXAMPLES

An example application of mobile seawater injection system 10 is performed for a platform in a marginal oil field in offshore Thailand. Mobile seawater injection system 10 is installed on a wellhead platform. Seawater is injected into a single well to waterflood an oil reservoir, with the offtake being from a single oil well.

Figure 4:
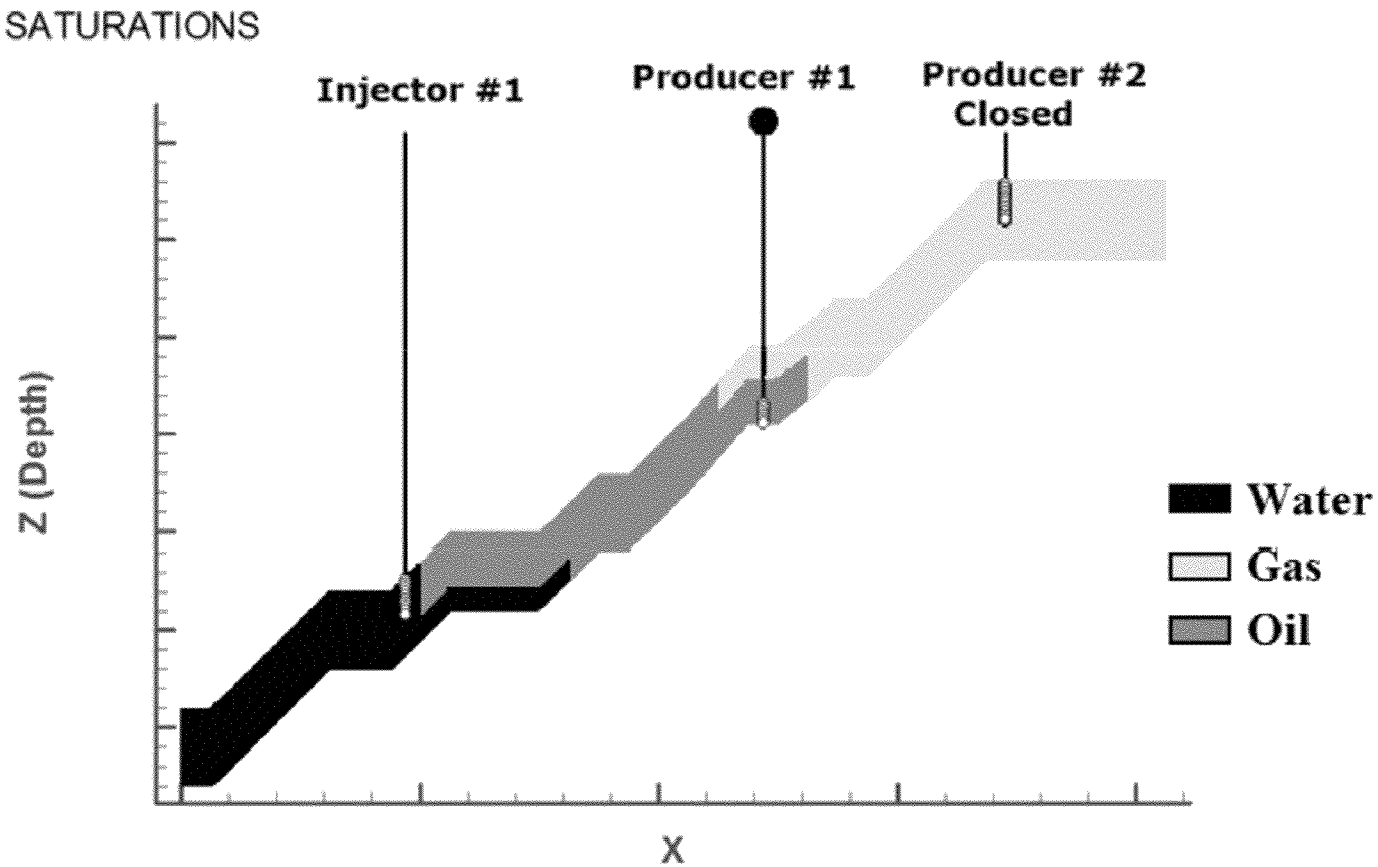
FIG. 4 is a schematic of the reservoir model used for simulation of a waterflooding process according to an embodiment of the present invention for enhancing oil recovery from a subsea reservoir.

FIG. 4 is a schematic of the reservoir model, which has original oil in place of approximately 2.2 million stock tank barrels (MMSTB). As shown in FIG. 4, due to the close proximity of the producing well 'Producer #1' to the gas cap of the reservoir, the well would ordinarily see high gas production very early in the producing life, at the expense of lower oil production. This would deplete the gas cap quickly, thus reducing reservoir pressure and leave behind large quantities of upswept oil down dip of the producing well.

However, with injection support from the 'Injector #1' location, reservoir pressure will be maintained and the influx of gas into 'Producer#1' will be far less prominent. This will allow oil volume located between the injector and producer to be swept towards the 'Producer #1' location. This will give the well sustained oil production and much higher recovery from the reservoir than what would be achieved without injection support. Given favorable reservoir and fluid properties to waterflooding, the injection rate could be up to three times the offtake rate to accelerate the waterflood response and recovery, and reduce the time mobile seawater injection system 10 has to be deployed on the platform.

Figure 5:
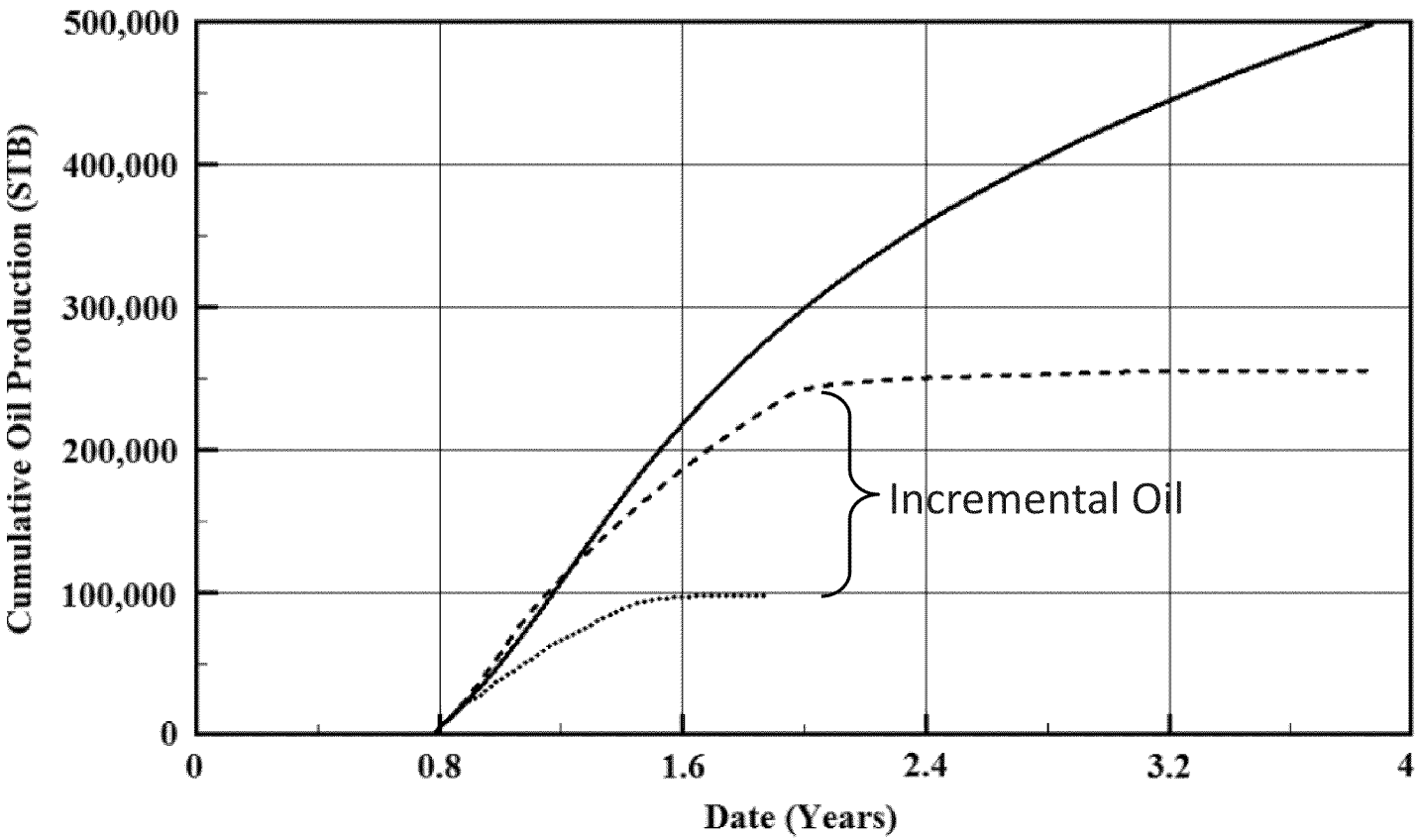
FIG. 5 is a graph illustrating simulation results of the waterflooding process for the reservoir model shown in FIG. 4 according to an embodiment of the present invention for enhancing oil recovery from a subsea reservoir.

FIG. 5 shows simulation results for the reservoir model shown in FIG. 4. Simulation studies indicate that application of mobile seawater injection system 10 will result in approximately 150,000 stock tank barrels (STB) of incremental oil recovered. In particular, the curve in dotted line represents cumulative oil under primary production and the curve in dashed line represents cumulative oil production for only three months of water injection. Water is injected at a rate of about 5000 barrels of water per day for a total of about 450,000 barrels of water injected over the three month injection period. While the water injection lasts for only three months, production benefits are gained for a longer period of time due to the increased pressure within the reservoir. The cost of the incremental oil gained from use of mobile seawater injection system 10 for the three month period is calculated to be less than $3 per barrel of incremental oil.

The curve in solid line in FIG. 5 represents cumulative oil for continuous water injection over the entire production life. While the produced cumulative oil is greater than that from an injection period of three months, there is diminishing return for mobile seawater injection system 10 as the oil production rate declines after water breakthrough such that the resulting cost per incremental barrel of oil is higher than in the case of a three month injection period. Therefore, after waterflooding a reservoir for a short injection period, mobile seawater injection system 10 can be demobilized and rigged up on another platform in the reservoir field to waterflood other small reservoirs.

With mobile seawater injection system 10, there is a low cost, flexible, and most importantly, mobile system that enables economic recovery of marginal oil reservoirs, especially since existing production wells can be converted into injection wells. Many marginal offshore reservoirs do not currently get waterflooded due to the high infrastructure costs of typical waterflooding systems. This results in a loss in reserves, which translates into lost revenue.

Figure 6:
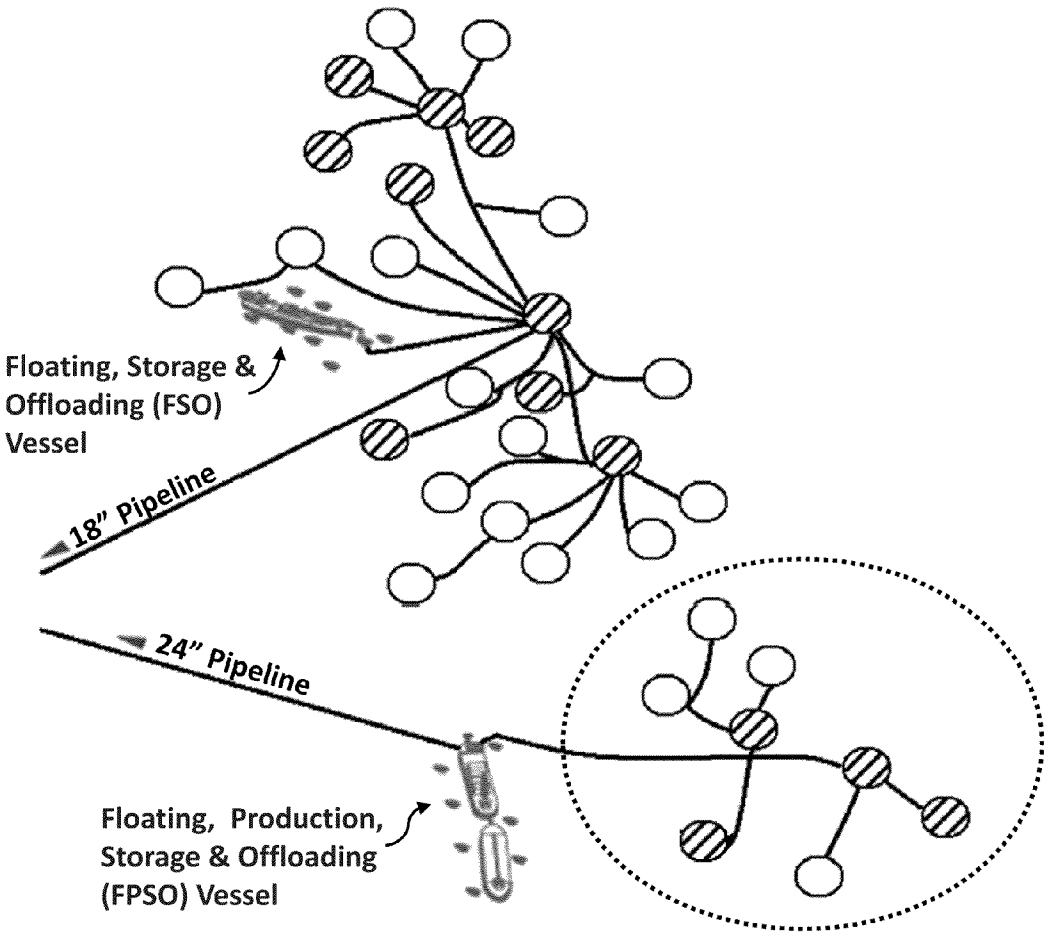
FIG. 6 is a schematic showing an exemplary marginal offshore reservoir, according to an embodiment of the present invention.

FIG. 6 shows a schematic of an exemplary marginal reservoir field that is being produced in offshore Thailand. The circles represent offshore platforms located throughout the reservoir field, which are connected through a plurality of production pipelines. Circles that have cross-hatching represent offshore platforms that are supplied with injection water through water pipelines from a produced water source. As shown in FIG. 6, less than have of the offshore platforms are supplied with injection water due to logistical and economic limitations that preclude the use of waterflooding.

Figure 7:
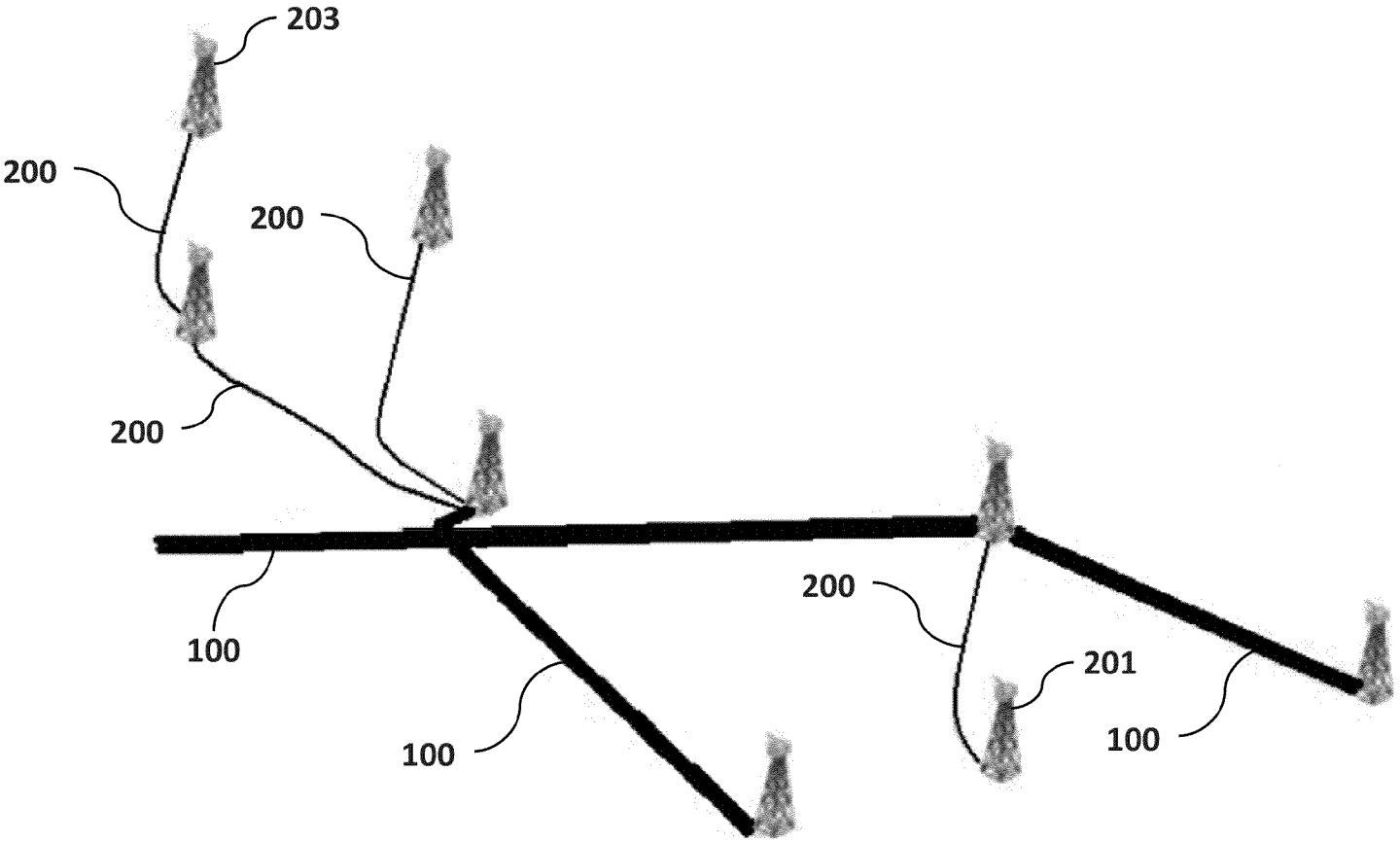
FIG. 7 is an enlarged section view of FIG. 6, according to an embodiment of the present invention.

FIG. 7 shows an enlarged section view of a portion of the marginal reservoir field shown in FIG. 6. Pipelines 100 and 200 are used to transport produced reservoir fluids to onshore for refining or processing facilities, or to a Floating, Production, Storage & Offloading (FPSO) Vessel or a Floating, Storage & Offloading (FSO) Vessel. Pipelines 100 also include water pipelines to supply offshore platforms with injection water from a produced water source. Accordingly, offshore platforms in fluid communication with pipeline 100 can be waterflooded using conventional techniques. Offshore platforms that are only in communication with pipeline 200 are not supplied with injection water and therefore, cannot be waterflooded using conventional techniques. In particular, offshore platforms that are only in communication with pipeline 200 typically cannot justify dedicated sea water injection systems or produced water reinjection pipelines.

Offshore platforms 201,203 were identified as being candidates for use of mobile seawater injection system 10. In particular, offshore platforms 201,203 were associated with small, homogeneous, high permeability reservoirs that were high dip, had a favorable mobility ratio, and contained light oil. Mobile seawater injection system 10 was mobilized to offshore platform 201. Successful interference/pulse tests were performed confirming that the target waterflood reservoir was in pressure communication from an injection well on offshore platform 201 to an adjacent production well. Mobile seawater injection system 10 was used to fracture the formation to establish injectivity. An average injection rate of 5000 barrels of water per day (bwpd) was used with a tubing head pressure of 1300 psi.

After seven (7) weeks of operation, the cumulative injection was 260 Mbbl at $1.1/bbl injected. During injection, oxygen levels were 0 ppb, which indicates a successful chemical treatment program. Two weeks into operation of mobile seawater injection system 10, the adjacent production well was opened and flowed for 5 days at a constant 26/64" choke. The oil rate increased from 964 to 1172 barrels of oil per day (bopd). The pressure increased from 560 psi to 820 p.s.i. The gas rate dropped from 1.4 MMscf/d to 0.1 MMscf/d. GOR dropped from about 4000 scf/bbl to less than 100 scf/bbl. Water remained at 0 bwpd. After seven (7) weeks of production, the rate was 2100 barrels of oil per day (bopd) with 0 barrels of water per day (bwpd). Over this time the reservoir has produced 80 Mstb of oil at $3.5/STBO lifting cost due to the application of seawater injection system 10.

Mobile seawater injection system 10 was then mobilized to offshore platform 203. After successful pulse tests were performed to show pressure communication from an injection well on offshore platform 203 to an adjacent production well, mobile seawater injection system 10 was used to fracture the formation and establish injectivity. An average injection rate of 5000 barrels of water per day (bwpd) for a period of about two months was used.

Figure 8:
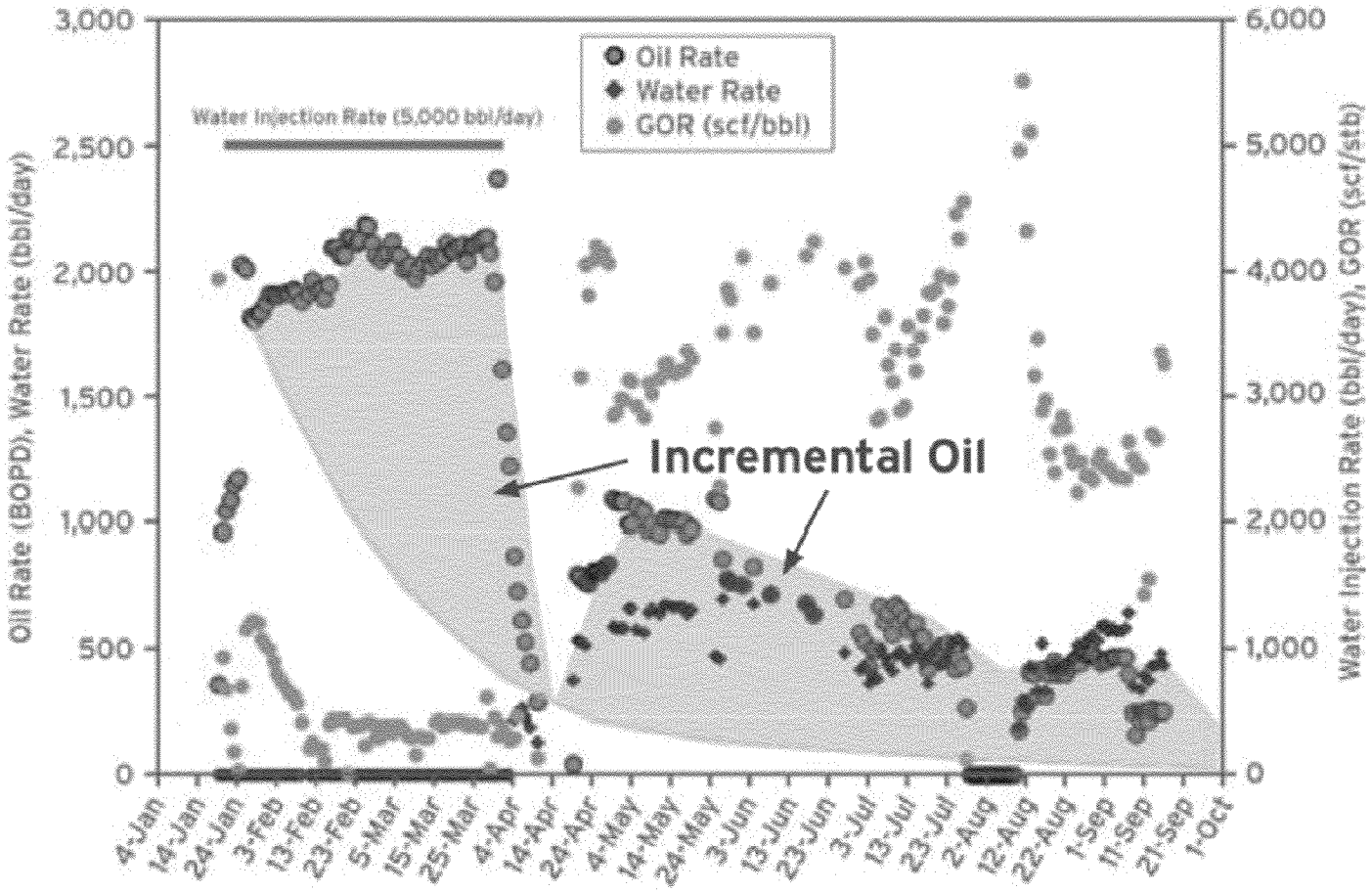
FIG. 8 is a graph showing performance results of mobile seawater injection system on an offshore platform, according to an embodiment of the present invention.
Figure 9:
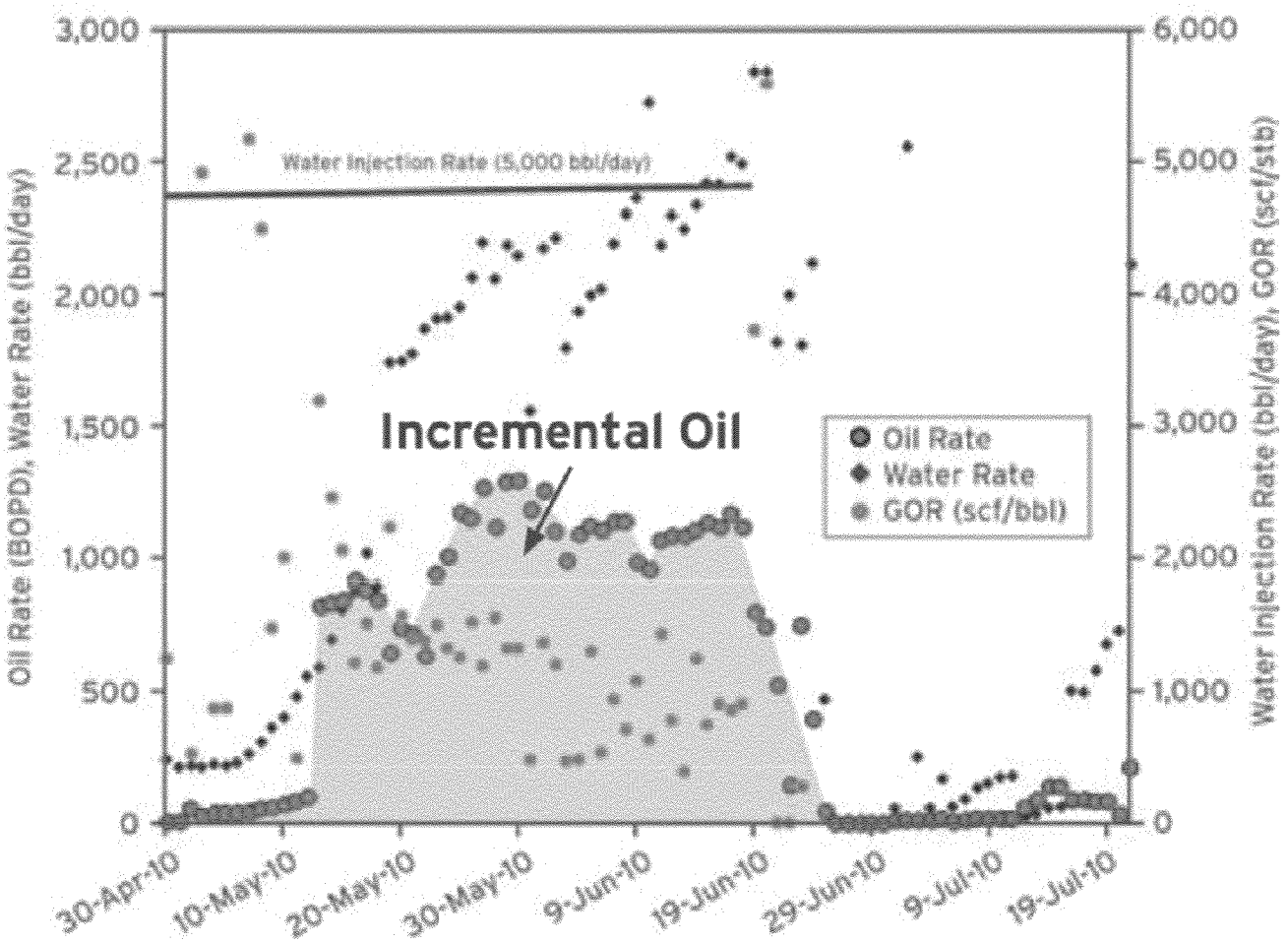
FIG. 9 is a graph showing performance results of mobile seawater injection system on an offshore platform, according to an embodiment of the present invention.

FIGS. 8 and 9 show results for mobile seawater injection system 10 on offshore platforms 201,203, respectively. Incremental oil due to each waterflood was at about $3/BOE and is shown in FIGS. 8 and 9 by the shaded areas. Water was injected at high rates and high pressures above the reservoir fracture pressure, allowing the reservoirs to be processed very rapidly at 50% to 100% of hydrocarbon pore volume injection per year. Further, the injection allowed for benefits of water injection to be felt long after mobile seawater injection system 10 was rigged down and moved to another location.

Offshore platforms 201,203 were selected for utilizing the portable waterflooding injection system based on a forecast of the incremental hydrocarbon recovery obtained from each. Typically, the portable waterflooding injection system is utilized on a plurality of offshore platforms in an order based on the forecasted incremental hydrocarbon recovery. For example, the portable waterflooding injection system is used first on the offshore platform forecasted to have the highest incremental hydrocarbon recovery, and then moved to the offshore platform with the next highest incremental hydrocarbon recovery. In some embodiments, a different performance metric such as maximizing net present value or ultimate hydrocarbon recovery can be used to order the use of the portable waterflooding injection system. Additionally, distance from the current platform can also be a factor in ordering.

While in the foregoing specification this invention has been described in relation to certain preferred embodiments thereof, and many details have been set forth for purpose of illustration, it will be apparent to those skilled in the art that the invention is susceptible to alteration and that certain other details described herein can vary considerably without departing from the basic principles of the invention.

What is claimed is:

1. A method of waterflooding a subsea reservoir, the method comprising:

(a) providing a subsea reservoir having hydrocarbons therewithin;

(b) providing a plurality of offshore platforms each having a wellbore in fluid communication with the subsea reservoir;

(c) assembling a portable waterflooding injection system on one of the plurality of offshore platforms, the portable waterflooding injection system comprising a skid mounted submersible pump to recover sea water capable of being lifted with a standard platform crane, a skid mounted tank to hold the seawater, capable of being lifted with a standard platform crane and a skid mounted injection pump to pump the sea water into the subsea reservoir capable of being lifted with a standard platform crane;

(d) injecting sea water into the subsea reservoir for a predetermined amount of time using the portable waterflooding injection system wherein step (c) further comprises connecting the submersible pump below the sea surface to pump sea water to a deck of at least one of the plurality of the offshore platforms, mounting the tank on the deck, the tank being in fluid communication with the submersible pump such that the tank receives the sea water pumped from the submersible pump; and mounting the injection pump on the deck, the injection pump being in fluid communication with the tank and the wellbore such that the injection pump receives the sea water from the tank and pumps it into the subsea reservoir; and (e) producing hydrocarbons from the subsea reservoir.

2. The method of claim 1, further comprising:

(f) disassembling the portable waterflooding injection system from the one of the plurality of offshore platforms; and (g) repeating steps (c) through (e) at another one of the plurality of offshore platforms.

3. The method of claim 1, wherein the sea water injected in step (d) is injected through the wellbore on the offshore platform to which the portable waterflooding injection system is assembled.

4. The method of claim 1, wherein step (d) further comprises injecting seawater into the wellbore at an injection rate of at least 4500 barrels of water per day.

5. The method of claim 1, wherein step (d) further comprises maintaining a tubing head pressure of at least 1000 p.s.i. in the wellbore.

6. The method of claim 1, wherein:

each of the wellbores in step (b) are components of production wells; and the production well on the offshore platform to which the portable waterflooding injection system is assembled is converted to an injection well prior to step (d).

7. The method of claim 1, further comprising:

(g) forecasting the incremental hydrocarbon recovery obtained from utilizing the portable waterflooding injection system on each of the plurality of offshore platforms; and (h) utilizing the portable waterflooding injection system on each of the plurality of offshore platforms in an order based on the forecasted incremental hydrocarbon recovery.

8. A method of waterflooding a subsea reservoir, the method comprising (a) providing a subsea reservoir having hydrocarbons therewithin;

(a) providing an offshore platform having a production well in fluid communication with the subsea reservoir;

(c) converting the production well to an injection well;

(d) transporting a portable waterflooding injection system to the offshore platform, the portable waterflooding injection system comprising a submersible pump to recover sea water, a tank to hold the seawater, and an injection pump to pump the sea water to the injection well, the submersible pump is connected below the sea surface to pump sea water to a deck of the offshore platform, the tank is mounted on the deck of the offshore platform, the tank being in fluid communication with the submersible pump such that the tank receives the sea water pumped from the submersible pump; and the injection pump is mounted on the deck of the offshore platform, the injection pump being in fluid communication with the tank and the injection well such that the injection pump receives the sea water from the tank and pumps it through the injection well into the subsea reservoir; and (e) injecting sea water through the injection well into the subsea reservoir for a predetermined amount of time using the portable waterflooding injection system; and (f) producing hydrocarbons from the subsea reservoir using a second production well, the second production well being in fluid communication with the subsea reservoir and the offshore platform.

9. The method of claim 8, wherein step (e) further comprises injecting seawater into the injection well at an injection rate of at least 4500 barrels of water per day and maintaining a tubing head pressure of at least 1000 p.s.i. in the injection well.

10. The method of claim 8, wherein the submersible pump, the tank, and the injection pump are each mounted on skids such that they can be lifted with a standard platform crane.

11. A method of optimizing a waterflood in a subsea reservoir, the method comprising:

(a) providing a subsea reservoir having hydrocarbons therewithin;

(b) providing a plurality of offshore platforms each having a wellbore in fluid communication with the subsea reservoir and wherein each of the wellbores in step (b) are components of production wells; and at least one production well is converted to an injection well on each offshore platform to which the portable waterflooding injection system is utilized prior to step (e) and at least one of the wellbores in step (b) is a component of a production well, and hydrocarbons are produced from the subsea reservoir using the production well;

(c) providing a portable waterflooding injection system comprising a submersible pump to recover sea water, a tank to hold the seawater, and an injection pump to pump the sea water into the subsea reservoir;

(d) forecasting the incremental hydrocarbon recovery obtained from utilizing the portable waterflooding injection system on each of the plurality of offshore platforms;

(e) utilizing the portable waterflooding injection system on each of the plurality of offshore platforms in an order based on the forecasted incremental hydrocarbon recovery wherein, step (e) further comprises: assembling the portable waterflooding injection system on one of the plurality of offshore platforms, injecting sea water for a predetermined amount of time into the subsea reservoir using the portable waterflooding injection system, the sea water being injected through the wellbore on the offshore platform to which the portable waterflooding injection system is assembled; and producing hydrocarbons from the subsea reservoir.

* * * * *

UNITED STATES PATENT AND TRADEMARK OFFICE

CERTIFICATE OF CORRECTION

PATENT NO. : 8,813,854 B2
APPLICATION NO. : 12/974656
DATED : August 26, 2014
INVENTOR(S) : Akshay Sahni and Jarrad Rexilius It is certified that error appears in the above-identified patent and that said Letters Patent is hereby corrected as shown below:

In the Claims

Col. 12 lines 23-31 should read,

7. The method of claim 1, further comprising:
   (f) forecasting the incremental hydrocarbon recovery obtained from utilizing the portable waterflooding injection system on each of the plurality of offshore platforms; and
   (g) utilizing the portable waterflooding injection system on each of the plurality of offshore platforms in an order based on the forecasted incremental hydrocarbon recovery.

Col. 12 lines 32-62 should read,

8. A method of waterflooding a subsea reservoir, the method comprising
   (a) providing a subsea reservoir having hydrocarbons therewithin;
   (b) providing an offshore platform having a production well in fluid communication with the subsea reservoir;
   (c) converting the production well to an injection well;
   (d) transporting a portable waterflooding injection system to the offshore platform, the portable waterflooding injection system comprising a submersible pump to recover sea water, a tank to hold the seawater, and an injection pump to pump the sea water to the injection well, the submersible pump is connected below the sea surface to pump sea water to a deck of the offshore platform, the tank is mounted on the deck of the offshore platform, the tank being in fluid communication with the submersible pump such that the tank receives the sea water pumped from the submersible pump; and the injection pump is mounted on the deck of the offshore platform, the injection pump being in fluid communication with the tank and the injection well such that the injection pump receives the sea water from the tank and pumps it through the injection well into the subsea reservoir; and
   (e) injecting sea water through the injection well into the subsea reservoir for a predetermined amount of time using the portable waterflooding injection system; and Signed and Sealed this
Thirtieth Day of December, 2014

Michelle K. Lee

Michelle K. Lee
*Deputy Director of the United States Patent and Trademark Office*

(f) producing hydrocarbons from the subsea reservoir using a second production well, the second production well being in fluid communication with the subsea reservoir and the offshore platform.